US005469817A

United States Patent [19]

Hoag

[11] Patent Number: 5,469,817

[45] Date of Patent: Nov. 28, 1995

[54] TURBULATOR FOR A LINER COOLING JACKET

[75] Inventor: Kevin L. Hoag, Columbus, Ind.

[73] Assignee: Cummins Engine Company, Inc., Columbus, Ind.

[21] Appl. No.: 299,540

[22] Filed: Sep. 1, 1994

[51] Int. Cl.[6] ..... F02F 1/14

[52] U.S. Cl. ..... 123/41.79; 165/109.1; 165/154

[58] Field of Search ..... 123/41.79; 165/154, 165/109.1

[56] References Cited

U.S. PATENT DOCUMENTS

| | | | |
|---|---|---|---|
| 1,231,904 | 7/1917 | Junkers . | |
| 1,410,319 | 3/1922 | Junkers . | |
| 1,904,459 | 4/1933 | Hefti . | |
| 2,001,854 | 5/1935 | Shoemaker et al. . | |
| 2,085,810 | 7/1937 | Ljungstrom | 123/41.79 |
| 3,831,672 | 8/1974 | Battisti | 123/154 |
| 4,667,635 | 5/1987 | Lichtblau | 123/41.8 |

*Primary Examiner*—Noah P. Kamen

*Attorney, Agent, or Firm*—Woodard, Emhardt, Naughton, Moriarty & McNett

[57] ABSTRACT

A turbulator for a liner cooling jacket includes a metal panel which is suitable to be coiled into a generally cylindrical shape so as to be placed in a relief area between an engine cylinder block and a cylinder liner. The relief area may be machined into either the block or the cylinder liner and the metal panel is formed with a pattern of protuberances shaped like corrugations. In one embodiment, the corrugations have a shape similar to a sine wave and are arranged in a plurality of generally parallel axial segments. The corrugation wave pattern of one segment may be the same as its adjacent segment or may be staggered by one corrugation which would mean one-half of a full wave cycle. The corrugation pattern in the turbulator panel may be created by any one of various stamping or forming operations and when placed between the cylinder liner and block, increases turbulence of the cooling liquid in order to enhance heat transfer.

6 Claims, 3 Drawing Sheets

TURBULATOR FOR A LINER COOLING JACKET

The United States government has an irrevocable, non-exclusive paid-up license in this invention and the right in limited circumstances to require the patent owner to license others on reasonable terms as provided for by the terms of contract #DEN3-375 awarded by the NASA.

BACKGROUND OF THE INVENTION

The present invention relates in general to the cooling of and the heat transfer from cylinder liners which are associated with internal combustion engines. More specifically the present invention relates to the use of a turbulator in the area of the cooling jacket which is disposed between the block and the cylinder liner.

In the field of cylinder liner design, cooling of the cylinder liner and in particular uniform cooling of the liner is an important consideration. Non uniformity in cylinder liner cooling results in localized hot spots which will adversely affect ring life and create lubricant deposit formation. Another consequence of nonuniformities in cylinder liner cooling is thermal distortion. In turn, thermal distortion results in increased oil consumption.

It has been found by enhancing the heat transfer coefficient around the cylinder liner that the cooling nonuniformities can be measurably reduced. In turn, one way to enhance the heat transfer coefficient is to create flow turbulence in the cooling fluid. More specifically, turbulence in the cooling fluid in the cooling jacket area will enhance the heat transfer coefficient throughout the cooling jacket and reduce temperature nonuniformities. An additional advantage is that enhanced heat transfer coefficients may be obtained while simultaneously reducing the coolant flow considerably. This allows the designer to use a smaller water pump, requiring lower horsepower and improving fuel consumption.

Over the years various efforts have been made to control or modify the cooling of internal combustion engines and in particular the cooling of cylinders and cylinder liners. The following patents are believed to be representative of such earlier efforts:

| Patent No. | Patentee | Issue Date |
|---|---|---|
| 2,085,810 | Ljungstrom | July 6, 1937 |
| 1,231,904 | Junkers | July 3, 1917 |
| 1,410,319 | Junkers | Mar. 21, 1922 |
| 1,904,459 | Hefti | Apr. 18, 1933 |
| 2,001,854 | Shoemaker et al. | May 21, 1935 |
| 4,667,635 | Lichtblau | May 26, 1987 |

In addition to what these six listed patents may disclose, some engine manufacturers have elected to machine scrolling or other relief around the cylinder liner perimeter surface in an attempt to enhance the heat transfer coefficient. Still other manufacturers have elected to cast fins around the cylinder liner perimeter. While these methods may provide some degree of enhancement, they represent extremely costly measures which then become prohibitive for many manufacturers in a price-competitive market.

The present invention is easy to fabricate and install and is far less expensive than competitive designs. The present invention significantly improves liner temperature distribution. The material options for the present invention, its adaptability and its variety of assembly options make the present invention well suited for a wide range of liner sizes and configurations.

SUMMARY OF THE INVENTION

A turbulator for a liner cooling jacket according to one embodiment of the present invention comprises a metal panel which is suitable to be coiled into a generally cylindrical shape and which is configured with any one of various patterns of raised panel protuberances. One such pattern which represents the preferred arrangement includes a first pattern of raised panel protuberances protruding in a first direction and a second pattern of raised panel protuberances protruding in a second direction wherein the second direction is opposite to the first direction.

One object of the present invention is to provide an improved turbulator design for a liner cooling jacket.

Related objects and advantages of the present invention will be apparent from the following description.

DESCRIPTION OF THE PREFERRED EMBODIMENT

Figure 1:
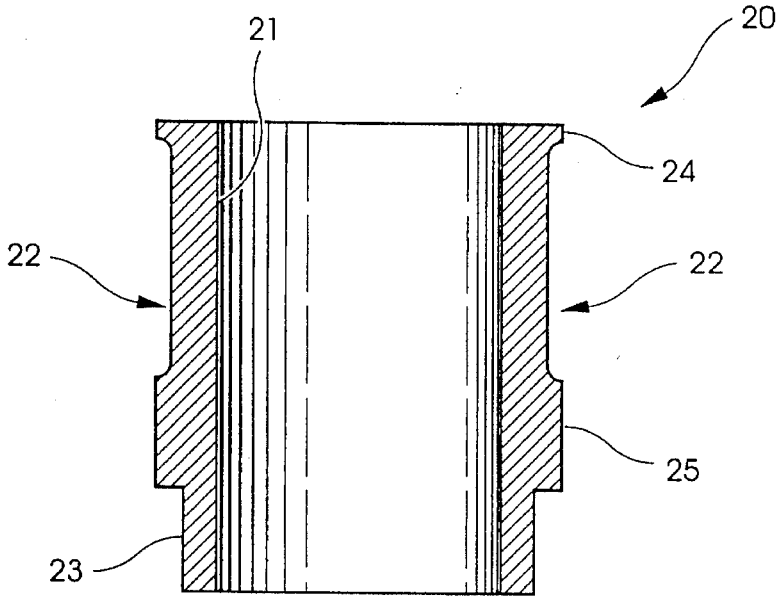
FIG. 1 is a partial, front elevational view in full section of a cylinder liner which is designed and contoured in a fashion suitable to be used in combination with the turbulator according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a representative cylinder liner 20 which is a hollow metal sleeve having a closely (precisely) machined bore 21. Annular relief 22 which is undercut into wall 23 below lip 24 and which ends prior to stop rib 25 constitutes the void space for a cooling jacket. Typical bores, apertures and flow paths (not illustrated) are provided for the requisite flow communication with the cooling jacket annular space. The design, sizing and locating of these bores, apertures and flow paths are aspects which are well-known to one of ordinary skill in the art.

Ultimately what is achieved is the flow of some cooling (heat transfer) fluid into and around the cooling jacket annular space in order to effect some degree of heat transfer from the cylinder liner 20. It is to be understood that the cylinder liner 20 of FIG. 1 represents only one of several possible cylinder liner constructions which are suitable for use with the present invention.

Figure 2:
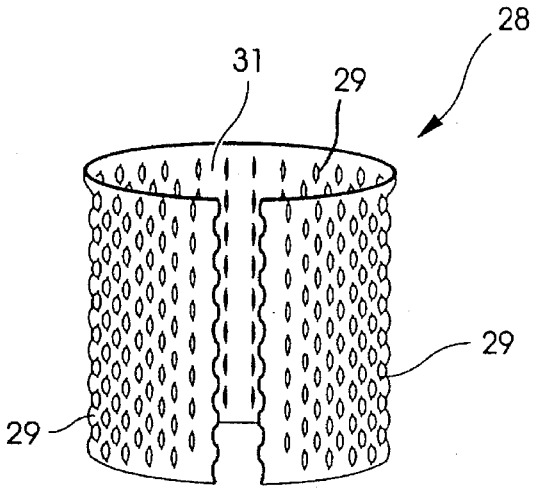
FIG. 2 is a perspective view of a turbulator which has been coiled into a general cylindrical configuration for placement around the FIG. 1 cylinder liner.
Figure 3:
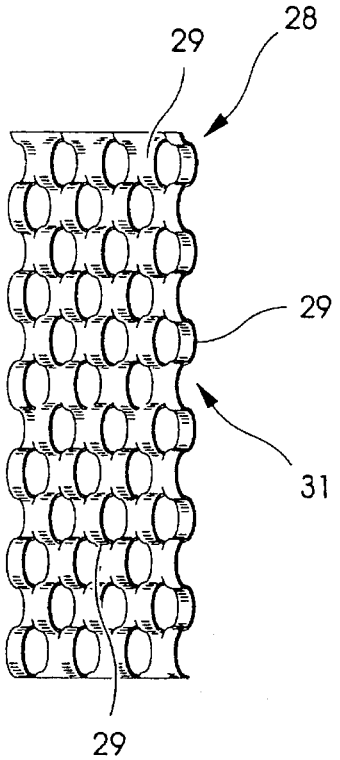
FIG. 3 is a partial, enlarged detail showing some of the surface deformation and flow passageways created as part of the FIG. 2 turbulator.

Referring now to FIGS. 2 and 3, a turbulator 28, designed in accordance with the present invention, is illustrated. Turbulator 28 begins as a metal panel or sheet of metallic material which is then formed with a repeating pattern of surface irregularities or protuberances 29. The preferred materials for the turbulator 28 are steel and stainless steel, though aluminum, brass, or copper could be used. The illustrated shape for these protuberances could be compared to a repeating pattern of corrugations having a sine wave shape. Thus, turbulator 28 can be thought of as a corrugated panel. These protuberances 29 or corrugations may be formed by anyone of various metal moving, stamping, rolling or forming operations. For example, turbulator 28 may be made by a metal stamping operation which not only forms the wave-shaped protuberances but as well simultaneously creates whatever slitting or cutting may be required between rows. This same metal stamping operation is capable of providing a varying pattern for the protuberances such that the actual arrangement may be uniform or staggered or completely random. Further, this metal stamping operation is suitable to be used in cooperation with materials such as steel, stainless steel or aluminum and thus there is a wide variety of material choices suitable for turbulator 28.

Protuberances (corrugations) 29 are sized and arranged to create turbulence in the flow of cooling liquid which circulates through the cooling jacket annular space. These protuberances also provide an increased total surface area over what a flat panel of the same height and diameter would provide. The greater surface area provides for more heat transfer to the cooling fluid.

The enlarged, partial detail of FIG. 3 shows the preferred row-to-row patterns of protuberances. The pattern which is illustrated provides alternating rows of sine wave protuberances. The protuberances are uniformly spaced in each row and have a virtually identical shape. Due to the sine wave shape, one protuberance extends in one direction and the adjacent protuberance extends in an opposite direction and this reversing wave pattern continues throughout each row. The protuberances extend in a direction normal to the direction of the alternating rows before the tubulator 28 is coiled. After coiling the turbulator 28, one group of protuberances extends in an outward radial direction and the other group of protuberances extends in an opposite radial direction. The rows extend circumferentially around the coiled turbulator. Alternate rows are evenly and uniformly staggered from the preceding or adjacent rows. Regardless of this preferred style and pattern, a point to be stressed is that the designer has freedom to configure and arrange the protuberances in any style desired and different patterns may be preferred depending upon the size and style of cylinder liners, the nature of the cooling liquid and the specific flow characteristics and heat transfer characteristics.

Figure 4:
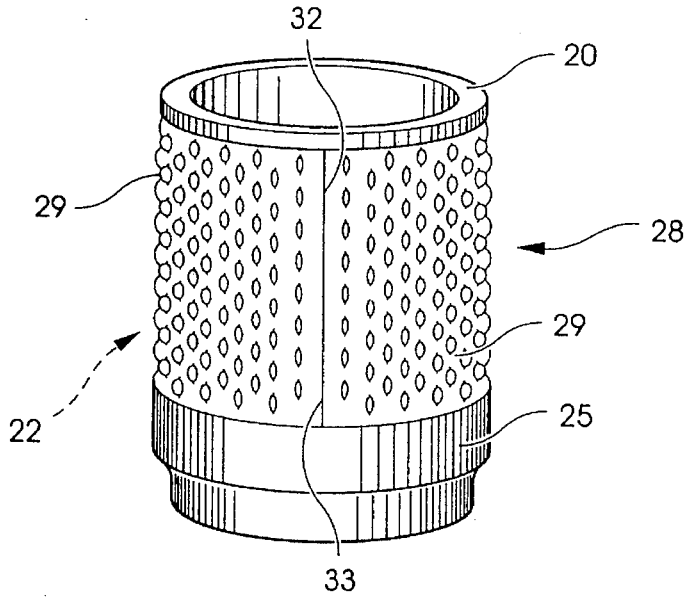
FIG. 4 is a perspective assembly illustration of the FIG. 2 turbulator as wrapped around the FIG. 1 cylinder liner.
Figure 5:
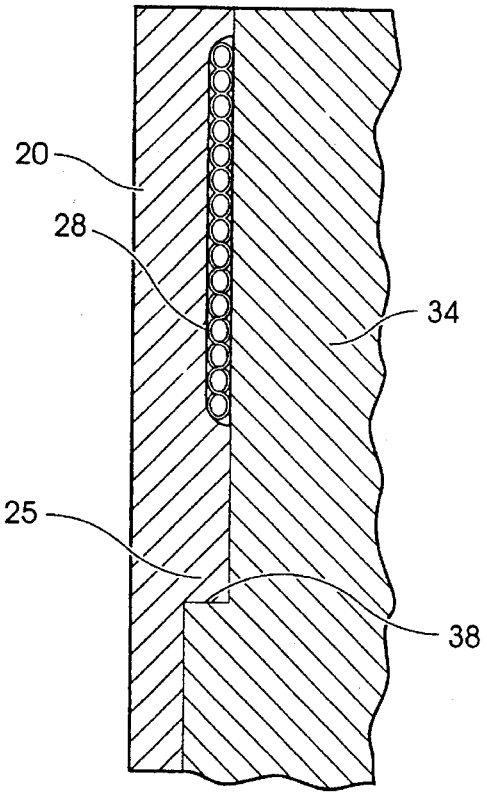
FIG. 5 is a partial, front elevational view in full section illustrating the relationship between the cylinder liner, turbulator and block.
Figure 6:
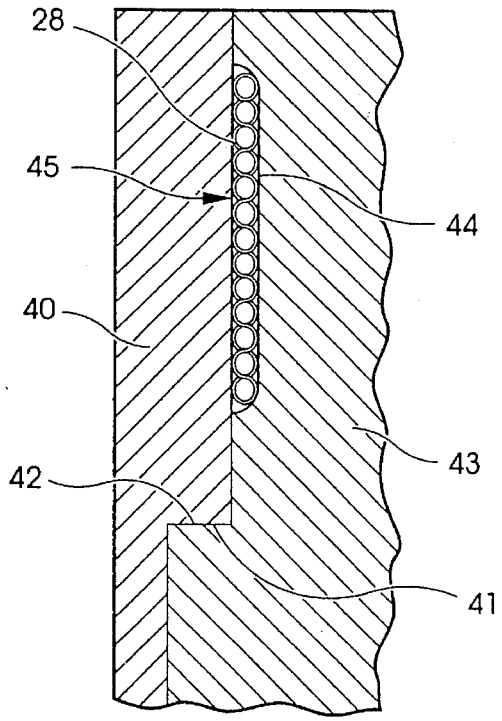
FIG. 6 is a partial, front elevational view in full section showing an alternative configuration for the assembly of the cylinder liner, turbulator and block.
Figure 7:
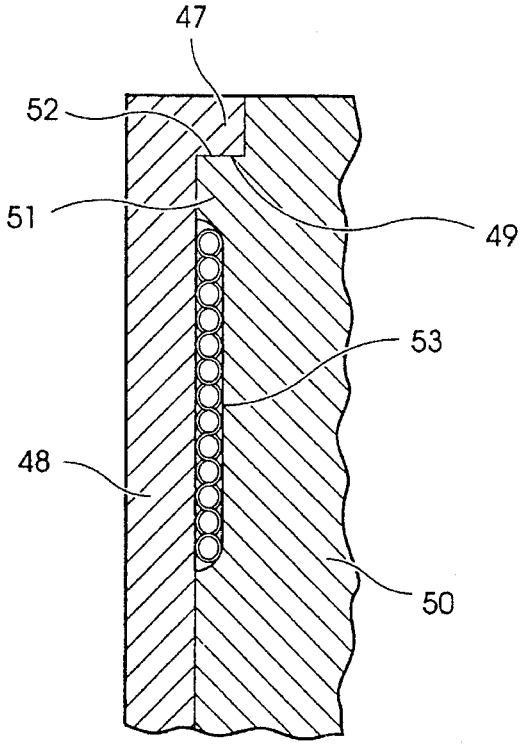
FIG. 7 is a partial, front elevational view in full section of yet another alternative configuration for the assembly of the cylinder liner, turbulator and block.

Referring now to FIG. 4, the turbulator 28 (or corrugated panel 28) is illustrated as it would be coiled and wrapped around cylinder liner 20 in the cooling jacket space (i.e., annular relief 22). The inside surface 31 of turbulator 28 which as previously described is alternately ribbed much like a sine wave with alternating protuberances 29. The rippled pattern or outwardly protruding protuberances 29 which have alternating and matching outwardly protruding protuberances from the opposite side of the panel (i.e., turbulator 28) create the cross-sectional configuration which is illustrated in FIGS. 5, 6 and 7. As will be explained hereinafter, it is important that the overall thickness of turbulator 28 which would be measured from the top or outer limit of the protuberances on one side of the turbulator panel to the alternating protuberances on the opposite side of the turbulator panel, be precisely controlled so that the desired fit between the cylinder liner and the block can be established.

After being coiled into a cylindrical shape and tightly wrapped around the cylinder liner, the abutting edges 32 and 33 may be seam welded or tack welded together in order to hold the desired cylindrical form and to hold the turbulator in position around the liner. Other methods of holding the coiled form of the turbulator may be used. The cylinder liner 20, as wrapped with the turbulator panel 28, is then installed as a unit into the block as illustrated in FIG. 5. It is possible to actually hold the turbulator in position around the liner as the combination is installed.

In the FIG. 5 illustration, while the turbulator 28 is very tightly wrapped around and secured in position on the cylinder liner 20, its outer surface is sized so as to require a light press fit within the block 34. As previously mentioned and as clearly illustrated in FIG. 5, the alternating pattern of protuberances 29 create a sine wave appearance in lateral cross-section. When as illustrated in FIG. 3 each alternating row of protuberances is staggered or shifted axially by one cycle or in the sense of a sine wave, a half cycle, from the preceding row, then the resulting cross-sectional appearance is what is illustrated.

Figure 5A:
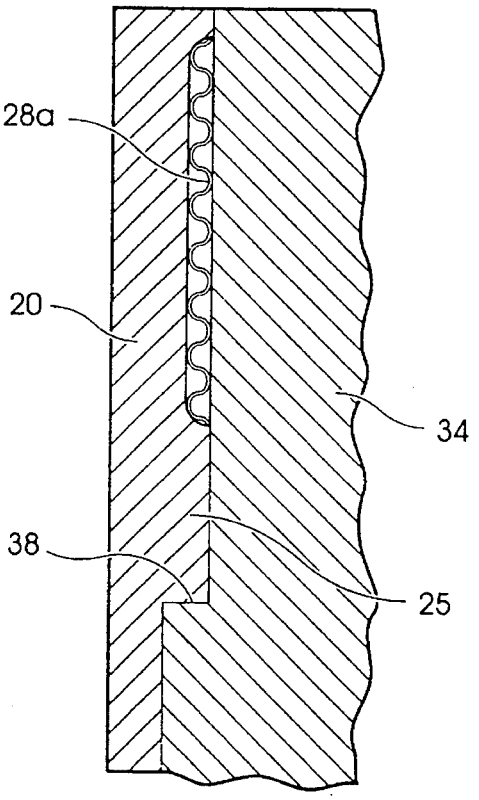
FIG. 5A is a partial, front elevational view in full section similar to FIG. 5 with a different style of turbulator.

If the alternating rows of protuberances 28 are not shifted axially from one another so as to stagger the protuberances by one full protuberance (½ sine wave), then the turbulator (now turbulator 28*a*) will have the cross-sectional shape as illustrated in FIG. 5A.

Machining of a generally cylindrical bore in the block in order to receive the cylinder liner and turbulator unit can be easily accomplished. In this manner the desired level of press fit can also be controlled. In the context of classifying various interference or press fits, the American Standards Association has published a guide and assigned numerical "class" designators to the type of fit. When the fit between the turbulator and block is described as "light" it means either a Class 6, tight fit or a Class 7, medium force fit. In these two classes the average interference of metal ranges from one ten thousandth of an inch to much as four or five thousandths of an inch, depending on the diameter sizes.

Concluding the FIG. 5 assembly, the cylinder liner and turbulator unit is installed into the block until stop rib 25 abuts up against ledge 38. This particular assembly represents a design for the present invention where the cylinder liner is machined with a relief area in order to create the cooling jacket space and in order to provide a location for turbulator 28. One alternative to this configuration (see FIGS. 6 and 7) is to generally leave the cylinder liner with a constant outside diameter, at least in the area of the cooling jacket, and machine the relief for the cooling jacket space directly into the block. The turbulator can then be coiled and slipped down into the block prior to assembly of the liner. Either style of turbulator 28 or 28*a* can be used in this arrangement or virtually any other style so long as the size and shape requirements are met. The tendency of the coiled turbulator panel to uncoil enables it to remain in position.

Referring specifically to FIG. 6, liner 40 is machined with an undercut ledge 41 which abuts up against ledge 42 in the block 43. These two abutting ledges provide a mid-range stop to halt the advancement of the cylinder liner at the desired depth into the block. Block 43 is machined with an annular cooling jacket relief 44 which receives turbulator 28. The outside diameter surface 45 of turbulator 28 after its assembly into relief 44 of block 43 establishes a diameter size which is sufficient to create light press fit with liner 40.

In the FIG. 7 embodiment, the design, size, fit, function and assembly are identical to the embodiment of FIG. 6 with one exception. In FIG. 7 the liner is shaped relative to the shaping of the bore in the block so as to provide an upper stop or upper abutment location. Radial lip 47 of liner 48 provides an underside abutment ledge 49 while block 50 has an annular abutment rib 51 which provides an upper abutment ledge 52. The cooling jacket relief 53 is machined into block 50 below rib 51.

In operation, cooling fluid is circulated into the cooling jacket space and around the cylinder liner. The elevated temperature of the cylinder liner is reduced to some extent by heat transfer through the wall of the liner into the cooling fluid. The heat transfer rate or coefficient is influenced by a number of factors. One factor is the thermal conductivity of the materials which are used. Another factor is the temperature difference between the liner and the cooling fluid. A still further factor is the surface area available to conduct off the heat of the cylinder liner. Another factor is the flow rate and turbulence of the cooling fluid.

By means of turbulator 28, turbulence is created in the cooling fluid and this enhances the heat transfer coefficient. One result is a more uniform heat distribution and more uniform liner cooling. This in turn causes a reduction in local hot spots. The increased surface area due to the formed corrugations or protuberances 29 gives the cooling fluid more "hot" surface to flow over and around. The turbulence created by the turbulator is more efficiently utilized because of this increased surface area.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In combination:

a cylinder block having a substantially cylindrical bore therein;

a cylinder liner constructed and arranged with a cooling jacket relief portion and positioned in said substantially cylindrical bore such that said relief portion is enclosed thereby defining a cooling jacket space;

a tubulator panel coiled around said cylinder liner and positioned in said cooling jacket space, said turbulator panel being constructed from a unitary sheet of metal and integrally formed with a repeating pattern of flow-through corrugations so as to create turbulence in the flow of a cooling liquid which circulates through said cooling jacket space;

wherein the repeating pattern of flow-through corrugations includes a first portion wherein the corrugations protrude radially outwardly from said turbulator panel in a first direction and a second portion wherein the corrugations protrude radially outwardly from said turbulator panel in a second direction, wherein said second direction is opposite to said first direction; and wherein said first portion of corrugations includes a plurality of rows of corrugations which rows are arranged side-by-side and extend in a circumferential direction.

2. The combination of claim 1 wherein said second portion of corrugations includes a plurality of rows of corrugations which rows are arranged side-by-side and extend in a circumferential direction.

3. The combination of claim 2 wherein adjacent corrugations of each row of said first portion are separated by adjacent corrugations of corresponding rows of said second portion.

4. In combination:

a cylinder block having a substantially cylindrical bore therein and being constructed and arranged with a cooling, jacket relief portion;

a substantially cylindrical cylinder liner which is positioned in said substantially cylindrical bore and axially extends across said cooling jacket relief portion such that said relief portion is enclosed thereby defining a cooling jacket space;

a turbulator panel coiled into a generally cylindrical form and positioned in said cooling jacket space, said turbulator panel being constructed from a unitary sheet of metal and being integrally formed with a repeating pattern of flow-through corrugations so as to create turbulence in the flow of a cooling liquid which circulates through said cooling jacket space;

wherein the repeating pattern of flow-through corrugations includes a first portion wherein the corrugations protrude radially outwardly from said turbulator panel in a first, direction and a second portion wherein the corrugations protrude radially outwardly from said turbulator panel in a second direction, wherein said second direction is opposite to said first direction; and wherein said first portion of corrugations includes a plurality of rows of corrugations which rows are arranged side-by-side and extend in a circumferential direction.

5. The combination of claim 4 wherein said second portion of corrugations includes a plurality of rows of corrugations which rows are arranged side-by-side and extend in a circumferential direction.

6. The combination of claim 5 wherein adjacent corrugations of each row of said first portion are separated by adjacent corrugations of corresponding rows of said second portion.

* * * * *